US005667413A

United States Patent [19]

Trafton

[11] Patent Number: 5,667,413

[45] Date of Patent: Sep. 16, 1997

[54] SOCKET-TYPE ELECTRICAL CONNECTOR

[75] Inventor: Michael L. Trafton, Dearborn, Mich.

[73] Assignee: Alcoa Fujikura Ltd., Brentwood, Tenn.

[21] Appl. No.: 556,494

[22] Filed: Nov. 13, 1995

[51] Int. Cl.[6] ..... H01R 13/52; H01R 13/187

[52] U.S. Cl. ..... 439/843; 439/271; 439/851

[58] Field of Search ..... 439/842, 843, 439/851–857, 861, 862, 825, 826, 271

[56] References Cited

U.S. PATENT DOCUMENTS

| | | | |
|---|---|---|---|
| 3,161,451 | 12/1964 | Neidecker | 439/843 |
| 3,673,541 | 6/1972 | Volinskie | 439/271 |
| 4,550,972 | 11/1985 | Romak | 439/843 |
| 4,553,807 | 11/1985 | Cane | 439/271 |
| 4,632,487 | 12/1986 | Wargula | 439/271 |
| 5,474,479 | 12/1995 | Bennett et al. | 439/843 |

*Primary Examiner*—J. J. Swann

*Attorney, Agent, or Firm*—Gifford, Krass, Groh, Sprinkle, Patmore, Anderson & Citkowski, P.C.

[57] ABSTRACT

A female electrical connector includes a housing defining a generally cylindrical bore therewithin. The connector includes a contact cage disposed, and retained, within the housing. The contact cage includes a number of contact blades disposed so as to provide a radial resilience. In some embodiments, an environmental seal is retained within the housing. The connector provides a high current capacity, low insertion force connector which may be readily fit over post-type electrical terminals.

16 Claims, 2 Drawing Sheets

SOCKET-TYPE ELECTRICAL CONNECTOR

FIELD OF THE INVENTION

This invention is related generally to electrical connectors. More specifically, the invention is related to a socket-type female electrical connector configured to removably engage a post-type terminal.

BACKGROUND OF THE INVENTION

There are a variety of electrical connectors utilized to establish reversible electrical connection between cables, wires and electrical devices Reversible electrical connectors are particularly important in a vehicular setting since they simplify assembly and service of the electrical components of the vehicle. Connectors may be utilized in low current applications such as for the installation of sensors and control circuits, or for a high current circuits such as those associated with starters alternators, heaters and lights.

The present invention is directed to barrel of socket-type female terminals of the type which include a radially resilient socket configured to receive post, pin or other such conductor therein. While such terminals are often utilized for high current applications, they may also be employed in low current circuits.

A number of socket type connectors known in the prior art. For example, U.S. Pat. No. 4,657,335 discloses a socket-type terminal which includes a cylindrical housing having a number of radially resilient elements disposed in an angular relationship to the axis of the cylinder. U.S. Pat. No. 4,550,972 discloses another configuration of socket-type terminal. U.S. Pat. No. 4,002,400 and U.S. Pat. No. 4,772,704 both disclose socket-type terminals having radially resilient members therein.

Ease of insertion and maintenance of a positive connection are generally important in socket-type electrical terminals, and in a manufacturing setting it is desirable that assembly be readily accomplished without the use of specialized tools, and preferably one-handedly. It is particularly important in a vehicular setting that electrical connectors be environmentally sealed and resistant to loosening when jarred, vibrated or thermally cycled. Maintenance of connection is particularly important in high current applications, since a partial disconnection can result in a high resistivity contact which can overheat and cause significant damage. It is further desirable that connectors for vehicular applications be readily amenable to use with protective covers, connector position assurance devices and the like.

The present invention is directed to a socket-type female terminal which is simple in construction and has a high current carrying capacity. The terminal of the present invention has a very low insertion force, and may be readily coupled onto a post-type connector using only hand. The connector of the present invention provides a very tight grip to the post and is resistant to loosening. The connector may be configured to include locking hardware, sealing gaskets, protective covers and the like. These and other advantages of the present invention will be readily apparent from the drawings, discussion and description which follow.

BRIEF DESCRIPTION OF THE INVENTION

There is disclosed herein a female electrical connector which comprises a housing having an open end. The housing defines an interior surface having a first portion thereof which encloses a generally cylindrical interior volume. A contact cage is disposed within, and in electrical communication with, the housing. The contact cage includes a contact portion, a base portion and a support portion which is joined to the contact and base portions. The contact portion is configured as a cylindrical member and is disposed within, and coaxially aligned with, the cylindrical interior volume of the housing. The contact portion includes a plurality of resilient contact blades each having a first end joined to the support portion of the contact cage. The connector further includes a retainer which fits into the housing and urges the base portion of the contact cage into engagement with the interior surface of the housing so as to thereby retain the contact cage within the housing.

The contact blades of the cage may include contact points defined thereupon which are disposed so as to project radially into the cylindrical interior volume, and function to increase the gripping force of the connector. In some embodiments, the contact points on adjacent blades are longitudinally displaced relative to one another. The base portion may comprise a frusto-conical member, generally comprised of a plurality of resilient elements projecting from the support member, and the housing may be configured so that a second portion of the interior surface encloses a frusto-conical interior volume. In this embodiment, the retainer urges the base portion of the contact cage into contact with the second portion of the interior surface. In some embodiments, the connector may include an elastomeric O-ring seal supported in the housing, in coaxial alignment with the cylindrical interior volume. An electrical terminal which is in electrical communication with the contact cage may be included for establishing contact to a cable or wire. The connector may be enclosed within a protective housing, and in some instances may be an integral portion of another component.

DETAILED DESCRIPTION OF THE INVENTION

Figure 1:
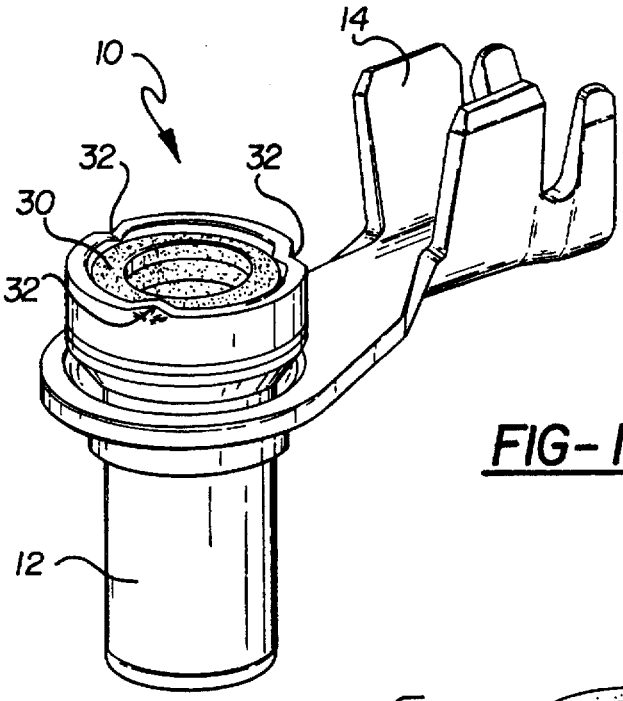
FIG. 1 is a perspective view of one embodiment of connector structured in accord with the principles of the present invention.

Referring now to FIG. 1, there is shown one configuration of connector 10 structured in accord with the principles of the present invention. Connector 10 of FIG. 1 is particularly configured to couple to a post type terminal of an alternator of a motor vehicle, although it is to be understood that the illustrated connector, as well as other connectors of the present invention may be configured to engage battery terminals, push pins and like members. The connector 10 of FIG. 1, as will be described in greater detail hereinbelow, includes housing 12 which is generally electrically conductive, and which is, in the illustrated embodiment, fabricated from a non-ferrous based alloy such as aluminum, brass or the like, although ferrous alloys may also be employed in some cases. The connector 10 includes a terminal body 14 joined in electrical communication with the housing 12. The terminal body 14 illustrated in FIG. 1 is a crimp on terminal of the type which may be readily engaged in electrical communication with a conductive wire, cable or the like. Clearly, other configurations of terminal and/or housing may be employed, depending upon particular application for which the connector is adapted. In some instances, the connector of the present invention may be directly incorporated into a component or system; in which case, the housing and terminal may comprise portions of the component or system itself.

Figure 2:
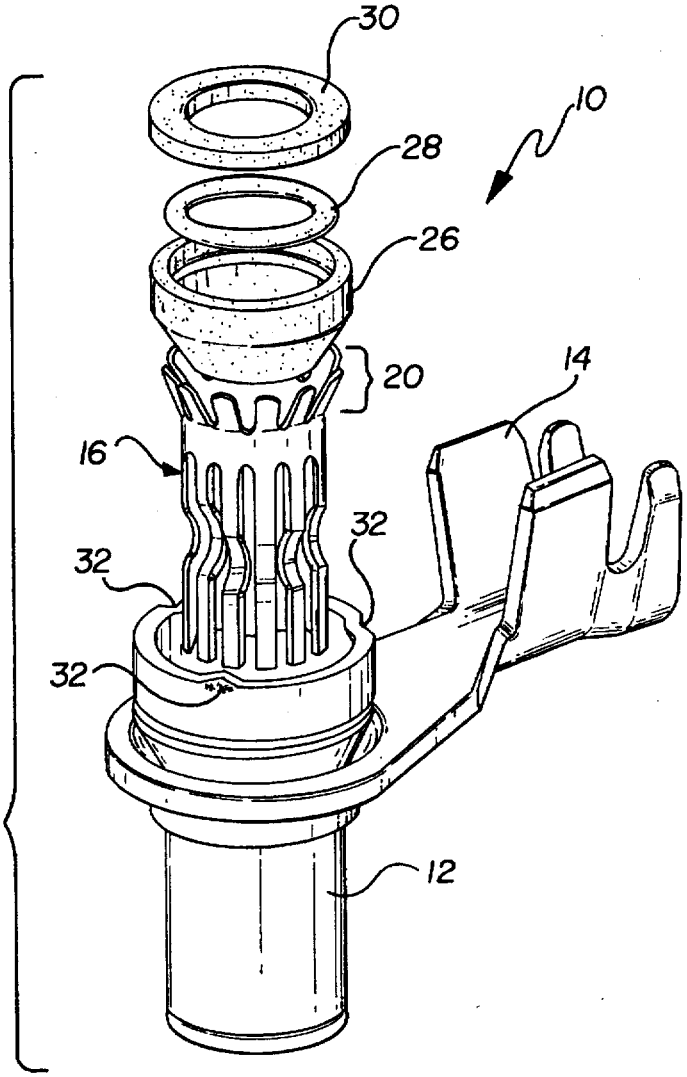
FIG. 2 is an exploded, perspective view of the connector of FIG. 1.
Figure 3:
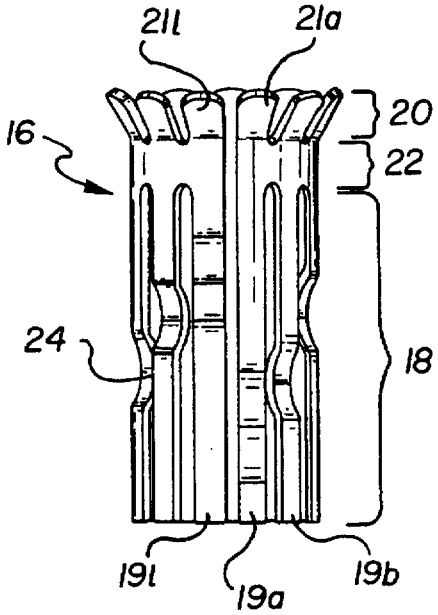
FIG. 3 is a side elevational view of a contact cage structured in accord with the principles of the present invention.

Referring now to FIG. 2, there is shown an exploded, perspective view of the connector 10 of FIG. 1 better illustrating the components thereof. As noted above, the connector includes a housing 12 having a terminal 14 joined thereto. Disposed within the housing is contact cage 16 fabricated from a relatively resilient, electrically conductive material such as a copper alloy material, steel, plated steel, brass, bronze or the like. The contact cage 16 is shown in enlarged detail in FIG. 3, and is preferably a unitary member which includes a contact portion 18, a base portion 20, and a support portion 22 therebetween. In the illustrated embodiment, the contact portion 18 is configured as a right cylindrical member comprised of a plurality of contact blades, for example blades 19*a* or 19*l* each having a first end which is joined to the support portion 22 of the contact cage 16. It will be noted that in this embodiment, each contact blade 19 includes a contact point 24 defined thereon by portion of the blade 19 which is bent so as to project radially inward with regard to the right cylindrical contact portion 18. In the illustrated embodiment, contact portions 24 on adjacent blades 19 are longitudinally displaced relative to one another, and in this manner decrease the maximum force required to insert a post-type terminal into the connector of the present invention.

In the illustrated embodiment, the contact cage 16 includes a base portion 20 which is of generally frusto-conical configuration and which is defined by a plurality of blades 21*a*–21*l*, projecting from the support portion 22.

Figure 4:
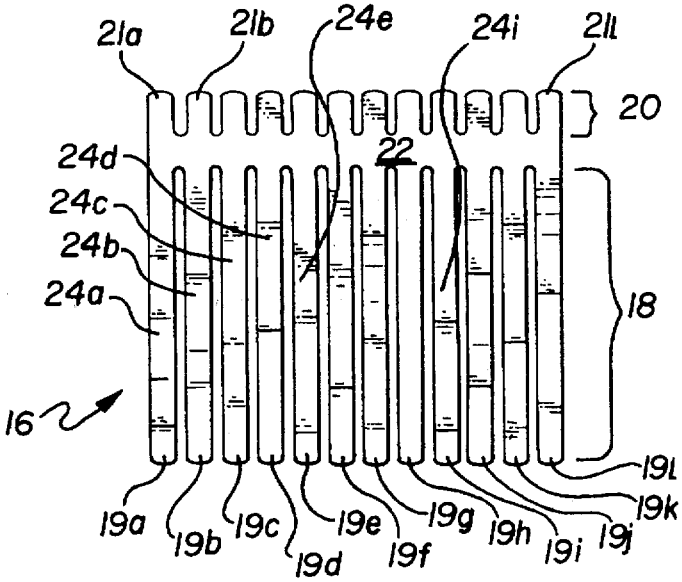
FIG. 4 is a top plan view of a blank utilized to fabricate the contact cage of FIG. 3.

Referring now to FIG. 4, the contact cage 16 of illustrated embodiment is shown in a flattened out form. Clearly visible in FIG. 4 are the blades 19*a*–19*l* which form the contact portion 18; the resilient members 21*a*–21*l* which form the base portion 20, and the support portion 22 therebetween. Each of the blades 19 includes a contact point 24 thereupon, and in the illustrated embodiment, the contact points are formed by embossed portions of the blade 19. It will be noted from the figure that the location of the contact points 24 is staggered; that is to say, contact point 24*a* of blade 19*a* is farther from the support member than is contact point 24*b* of blade 19*b*. Contact point 24*c* of blade 19*c* is closer to the support member 22 than is contact point 24*b*, and contact point 24*d* is the closest to the support member 22. Contact point 24*e*, associated with blade 19*e* is displaced away from the support member 22, and is at an approximately equal level with contact point 24*a*. Contact point 24*i* is also aligned with contact points 24*a* and 24*e*. In this manner, the contact points are varied so that they will be equally spaced throughout the interior surface of the cylinder defined by the contact portion of the contact cage. In the illustrated embodiment, the contact cage 16 includes twelve blades with four different positions for the contact points; thus, at any given level three contact points will be projecting into the cage at equally spaced intervals. Because of the smoothly varying location of the contact points, this particular connector is referred to as a wave finger terminal. It has been found that a configuration of this type provides a terminal which has a low insertion force, but which provides a positive retention of a connector disposed therein. It is to be understood that in accord with the present invention, the blades may be varied in shape and number from that shown in these figures. Furthermore, the number and location of the contact points may be varied. In some instances, a given blade may have more than one contact point, while in other instances a blade may not include any contact points. Such modifications will depend upon particular applications, and may be implemented by one of skill in the art.

Referring back to FIG. 2, it will be noted that the contact cage 16 is disposed so that the blades will project into a cylindrical portion of the housing 12 with the frusto-conical base portion closest to the open end of the housing. The connector 10 of FIG. 2 further includes a retainer 26 which, in this embodiment, includes a frusto-conical surface corresponding generally to the frusto-conical base portion 20 of the contact cage 16. The retainer 26 functions to bias the base portion 20 of the contact cage 16 into engagement, and electrical communication with the housing 12. The retainer 26 is typically fabricated from a polymeric or ceramic material; although it may, with equal advantage, be fabricated from a metal.

The connectors of the present invention will typically include a sealing member for excluding moisture, oil and dirt from the interior thereof, and in the illustrated embodiment, the connector 10 includes an o-ring seal 28 fabricated from an elastomeric material. The o-ring seal 28 is disposed so as to be axially aligned with the housing 12 and contact cage 16. The illustrated embodiment, the o-ring seal 28 fits into a recess formed in the retainer 26 and is held there against by a washer 30, which in turn is retained by crimped-in portions 32 of the housing 12, so as to hold the seal 28 within the housing 12. Other retention arrangements, such as a press-fit or a threaded engagement are contemplated by, and within the scope of, the invention.

Figure 5:
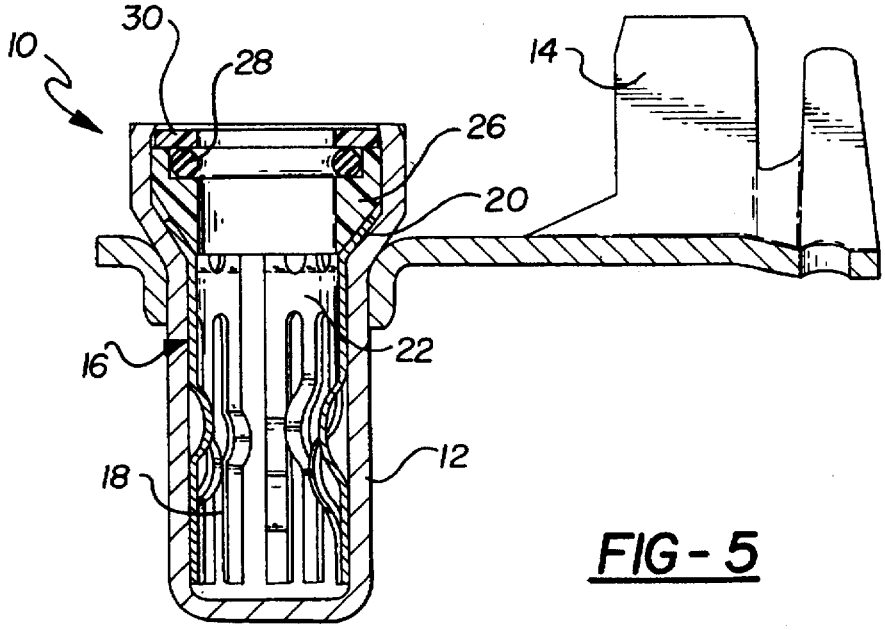
FIG. 5 is a cross sectional view of the connector of FIG. 1.

Referring now to FIG. 5, there is shown a cross-sectional view of the connector 10 of FIGS. 1 and 2. As will be seen from FIG. 5, the connector includes a housing 12 which is configured as a generally cylindrical canister. The housing is open at one end and closed at a second end, and a first portion of the housing is configured as a right cylinder, and a second portion thereof is generally frusto-conical. The contact cage 16 is disposed in the housing 12 with the contact portion thereof 18 and support portion thereof 22 within the cylindrical portion of the housing 12. As will be seen from the Figure, the retainer 26 includes a frusto-conical surface which acts to urge the base portion 20 of the contact cage 16 into engagement with the frusto-conical portion of the housing 12. The retainer 26 further functions to support the o-ring seal 28, the seal 28 is retained by the washer 30.

In this manner, the connector 10 provides an open bore at one end thereof for receipt of a contact post (not shown). The post in turn establishes electrical communication with the housing 12 through the cage 16. The resiliency of the contact cage 16 assures positive retention of the connector 10 on the post, and the high surface area provided by the contact cage 16 permits the flow of relatively large amounts of current, while the configuration of the wave fingers minimizes insertion force. The o-ring seal 28 engages the post thereby preserving the integrity of the electrical connection. As illustrated, a terminal member 14 is affixed in electrical communication with the housing 12, and may be coupled to a wire or cable.

Variations of the illustrated connector are possible within the scope of the present invention. For example, the housing 12 may be non-conductive, and the terminal 14 may establish electrical communication directly with the cage 16 by means of a wire, tab, strip or the like. In other instances, the housing 12 may include an opening at the second end thereof. This opening may be a relatively large configured so as to permit the connector to be slid along a relatively long connector member, and preferably include a second o-ring seal. In embodiments, the opening may be a relatively opening configured to permit a portion of a terminal to project therefrom. For example, the terminal may include a portion which projects through the connector of the present invention and is affixed thereto by means of a nut, clip or other fastener so as to provide for positive connection lock. In other embodiments, the illustrated terminal member, such as member 14 engaged with the housing 12, may be modified or eliminated. In yet other embodiments, the housing 12 may be covered with a layer of electrically insulating material, or disposed within an insulating housing. Further connector structures such as connector position assurance (CPA) devices may be included therewith. In some instances, the connector of the present invention may be configured to be an integral part of a component, device or the like. For example, a component may include a bore defined therein which receives the contact cage, and may further include a retainer for retaining the cage. In yet other embodiments, the housing, contact cage and/or retainer may be otherwise configured so as to provide for alternative structures wherein the contact cage is contained within the housing. All of such modifications and alternative embodiments are within the scope of the present invention.

In view of the foregoing it is to be understood that numerous modifications and variations of the present invention may be implemented. The foregoing drawings, discussion and description which follow are merely meant to illustrate particular embodiments of the invention and are not meant to be limitations upon the practice thereof. It is the following claims, including all equivalents, which define the scope of the invention.

I claim:

1. A female electrical connector comprising:

a housing having an open end, said housing defining an interior surface, a first portion of which encloses a generally cylindrical interior volume;

a contact cage disposed within, and in electrical communication with, said housing and including a contact portion, a base portion, and a support portion which is joined to said contact portion and said base portion, said contact portion comprising a cylindrical member, disposed within, and coaxially aligned with, said cylindrical interior volume, and including a plurality of resilient contact blades, each blade having a first end thereof which is joined to the support portion of said contact cage;

a retainer configured to fit into said housing and to urge the base portion of said contact cage into engagement with the interior surface of said housing so as to retain said contact cage therein; and an elastomeric o-ring seal supported in said housing, in coaxial alignment with said cylindrical interior volume, by said retainer.

2. A connector as in claim 1, wherein each of said contact blades includes a contact point defined thereupon, said contact points of said blades being disposed so as to extend radially into said cylindrical interior volume.

3. A connector as in claim 2, wherein the contact points on adjacent blades are longitudinally displaced relative to one another.

4. A connector as in claim 1, wherein said housing is configured as a cylindrical canister having a closed end opposite said open end.

5. A connector as in claim 1, wherein said base portion comprises a frusto-conical member.

6. A connector as in claim 5, wherein a second portion of the interior surface of said housing defines a frusto-conical interior volume and wherein said retainer urges the base portion of said contact cage into contact with the second portion of said interior surface.

7. A connector as in claim 5, wherein said base portion includes a plurality of resilient members joined to said support portion, in a spaced apart relationship so as to define said frusto-conical member.

8. A connector as in claim 1, further including a terminal body in electrical communication with said contact cage.

9. A connector as in claim 1, wherein said contact cage is comprised of a unitary body of a copper based alloy material.

10. A connector as in claim 1, wherein said housing is comprised of a non-ferrous alloy.

11. A female electrical connector comprising:

an electrically conductive housing configured as a generally cylindrical canister having an open end and a closed end, said housing including an interior surface having a first portion configured as a right cylinder and enclosing a right cylindrical interior volume, and a second portion configured as a frusto-conical surface and enclosing a frusto-conical interior volume;

a contact cage disposed within, and in electrical communication with, said housing, said contact cage including a right cylindrical contact portion, a frusto-conical base portion, and a right cylindrical support portion therebetween; said contact portion including a plurality of resilient contact blades, each blade comprising a generally elongated member having a first end which is joined to the support portion of said contact cage; said base portion comprising a plurality of resilient members joined to the support portion in a spaced apart relationship so as to define a frusto-conical surface corresponding generally to the second portion of said interior surface;

and, a retainer configured to fit into the frusto-conical volume of said interior surface and to urge the base portion of said contact cage into engagement with the second portion of said interior surface, said retainer including a central passageway therethrough, axially aligned with, and corresponding to, said right cylindrical interior volume.

12. A connector as in claim 11, further including an elastomeric o-ring seal supported in said housing by said retainer in axial alignment with said right cylindrical interior volume.

13. A connector as in claim 12, further including a washer which cooperates with said retainer to retain said o-ring seal in said housing.

14. A connector as in claim 13, wherein said housing includes at least one crimped-in portion which retains said washer therein.

15. A connector as in claim 11, wherein each blade of said contact cage includes a contact point defined thereupon, said contact points being disposed so as to extend radially into said cylindrical interior volume.

16. A connector as in claim 15, wherein the contact points on adjacent blades are longitudinally displaced relative to one another.

* * * * *